US005432758A

United States Patent [19]

Sone

[11] Patent Number: 5,432,758

[45] Date of Patent: Jul. 11, 1995

[54] ELECTROACOUSTIC TRANSDUCER

[75] Inventor: Takahiro Sone, Shizuoka, Japan

[73] Assignee: Star Micronics Co., Ltd., Shizuoka, Japan

[21] Appl. No.: 129,382

[22] Filed: Sep. 30, 1993

[30] Foreign Application Priority Data

Sep. 30, 1992 [JP] Japan ..... 4-286629
Sep. 30, 1992 [JP] Japan ..... 4-286631

[51] Int. Cl.[6] ..... H04R 25/00

[52] U.S. Cl. ..... 367/175; 367/185; 181/166; 181/172; 381/193; 381/202

[58] Field of Search ..... 367/182, 185, 174, 175; 181/148, 166, 157, 171, 172, 173; 381/192, 193, 202; 128/662.03

[56] References Cited

U.S. PATENT DOCUMENTS 4,234,766 11/1980 Cacho ..... 181/171
4,395,598 7/1983 Lesage ..... 181/172
4,823,110 4/1989 Dorward et al. ..... 340/388
4,843,628 6/1989 Hofer ..... 381/200
4,944,017 7/1990 Cognasse et al. ..... 381/79
5,091,958 2/1992 Sakamoto et al. ..... 381/50

*Primary Examiner*—J. Woodrow Eldred
*Attorney, Agent, or Firm*—Pollock, Vande Sande & Priddy

[57] ABSTRACT

An electroacoustic transducer having a diaphragm and a magnetic driving portion respectively housed in a housing wherein the magnetic driving portion vibrates the diaphragm magnetically in response to an electric signal. A base member for closing an opening at the rear side of the housing is formed of a metallic plate. Lead portions are provided by extending both ends of a coil of the magnetic driving portion. Terminal patterns are formed on a surface of the base member with an insulating film between them. The lead portions of the coil of the magnetic drive portion are connected to the terminal patterns.

7 Claims, 14 Drawing Sheets

ELECTROACOUSTIC TRANSDUCER

BACKGROUND OF THE INVENTION

1. Field of the Invention

The present invention relates to an electroacoustic transducer for converting an electric signal applied thereto into sound.

2. Description of the Prior Art

An electroacoustic transducer is a means for converting an electric signal applied thereto into sound. The electroacoustic transducer can produce an acoustic output in response to an input electric signal. Accordingly, the electroacoustic transducer can be employed by electronic devices, etc. as a sounding means such as a buzzer.

FIGS. 14 and 15 show a prior art electromagnetic type electroacoustic transducer. The electroacoustic transducer includes a housing 102 formed of synthetic resins.

The housing 102 houses therein a base portion 104 and a magnetic driving portion 105. The base portion 104 serves as a supporting member for the magnetic driving portion 105 as well as a closing means for an opening of the housing 102. The base portion 104 comprises seven pieces of five kinds, namely, a core 106, a base 108, a base plate 110, terminals 112 and 114 and caulking pins 116 and 118. The base plate 110 and the base 108 are fixed and double-structured by the core 106 which is penetrated through the two members and caulked at the rear end. The terminals 112 and 114 are respectively fixed to the base plate 110 by the caulking pins 116 and 118.

The core 106 constitutes a part of the magnetic driving portion 105. A coil 120 is wound around the periphery of the core 106 and has leads 122 and 124 which are connected individually to the terminals 112 and 114. An annular magnet 126 is provided around the peripheral portion of the coil 120. The magnet 126 is fixed to the base 108.

The housing 102 has a stepped portion 127 provided at the inner wall thereof which defines a small diameter portion at the front side thereof and a large diameter portion at the rear side thereof. An interval holding ring 128 is disposed between the stepped portion 127 and the base 108. The interval holding ring 128 is a means for supporting a diaphragm 130 while holding the interval between the diaphragm 130 and the end surface of the core 106. That is, the interval holding ring 128 has a receiving surface at the top portion thereof on which the diaphragm 130 is placed. The diaphragm 130 is spaced away from the end surface of the core 106 with a gap 132 which permits a mechanical vibration of the diaphragm 130. A magnetic piece 134 is fixed to the center of the upper surface of the diaphragm 130.

A resonant space 136 is provided inside the housing 102 for producing resonant vibration in response to the vibration of the diaphragm 130. A cylindrical sound emitting hole 138 is formed at the front side of the housing 102. The resonant space 136 is open to the atmosphere through the sound emitting hole 138.

When an electric signal having an appropriate level is applied between the terminals 112 and 114, the coil 120 is energized by the electric signal, which causes the diaphragm 130 to vibrate vertically, namely, upward and downward in FIG. 14. The vibration of the diaphragm 130 depends on amplitude and frequency of the electric signal to be applied thereto. As a result, sound is produced by the vibration of the diaphragm 130 and the resultant sound causes resonant space 136 to produce resonant vibration and it is thereafter discharged from the sound emitting hole 138 to the atmosphere. At this time, the base portion 104 serves to keep the rear side of the diaphragm 130 airtight, which contributes to a predetermined sound characteristics in the course of production of sound.

According to such an electroacoustic transducer, the base portion 104 occupies a very large volume of the housing 102, which prevents the miniaturization and the lightening of the electroacoustic transducer. The core 106 has been conventionally shortened in order to miniaturize and lighten the electroacoustic transducer. The shortening of the core 106 influences the number and form of windings of the coil 120, which weakens the magnetic field, and in turn decreases the magnetic driving force and the sound pressure.

Although the resonant space 136 occupies a large volume of the housing 102, if it is reduced, the electroacoustic transducer can be miniaturized. However, the reduction of the resonant space 136 leads to the deterioration of the resonant effect and is hence not advantageous. Since the resonant space 136 performs an important resonant effect in the course of production of sound, the acoustic characteristics may be much deteriorated by the reduction of the resonant space 136 rather than the decrease of the magnetic driving force due to the shortening of the core 106.

SUMMARY OF THE INVENTION

It is an object of the invention to provide an electroacoustic transducer that realizes a simplification of the base portion and that permits a miniaturized or thin construction without the deterioration of the acoustic characteristics.

It is another object of the present invention to provide an electroacoustic transducer that realizes a simplification of the core provided in the base portion.

That is, the electroacoustic transducer of the present invention, as shown in FIG. 1, comprises a diaphragm 30 and a magnetic driving portion 5 respectively housed in a housing 2 wherein the magnetic driving portion 5 vibrates the diaphragm 30 magnetically in response to an electric signal and it is characterized in that a base member (metal base plate 40) is formed of a metallic plate for closing an opening at the rear side of the housing 2, that terminal patterns (conductive patterns 50 and 52) are formed on the surface of the base member with an insulating film 48 between them and that lead portions of a coil of the magnetic driving portion 5 are connected to the terminal patterns (conductive patterns 50 and 52).

The following effects can be obtained by the present invention having the arrangement set forth hereinabove.

Firstly, the structure of the electroacoustic transducer can be simplified. The prior art base 108 and the base plate 110 are unified to form a single base member. Such a simplification of the base member can reduce the volume occupied by the base member in the housing. If the same housing as the prior art is used, the volume thereof can be effectively utilized. If the volume excluding the base portion is the same as the prior art, the housing can be miniaturized. Furthermore, since the base member is disposed in the direction of the thickness of the housing, the height thereof can be controlled, which provides a thinner electroacoustic transducer.

Secondly, the core can be shortened while keeping necessary effective length. In case the base 108 and the base plate 110 are double structured as in the prior art electroacoustic transducer, they need to be fixed by the caulked core 106. However, the present invention dispenses with such connection and fixation. It is sufficient that the core is fixed to the base member alone so that the length thereof can be shortened compared with the prior art core.

Thirdly, the terminal structure can be simplified. Terminal patterns are formed on the base member with the insulating film between them instead of the prior art terminals 112 and 114. The caulking pins 116 and 118 for fixing the terminals 112 and 114 are unnecessary which dispenses with the caulking operation of the terminals 112 and 114. This also leads to the simplification of the assembling operation.

Fourthly, the acoustic characteristics is improved. According to the present invention, the simplification of the base member also simplifies a vibrating structure, which restrains unnecessary vibration to thereby improve the acoustic characteristics.

The above and other objects, features and advantages of the present invention will become more apparent from the following description taken in conjunction with the accompanying drawings.

BRIEF DESCRIPTION OF THE PREFERRED EMBODIMENT

First embodiment (FIGS. 1 to 5)

An electroacoustic transducer according to a first embodiment will be described with reference to FIGS. 1 to 5.

Figure 14:
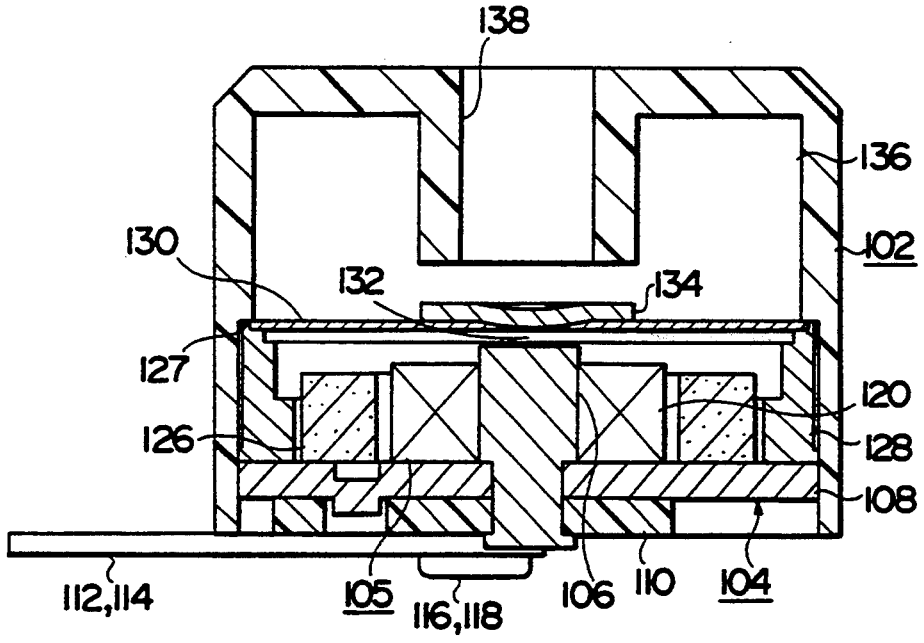
FIG. 14 PRIOR ART
FIG. 14 is a longitudinal cross-sectional view of a prior art electroacoustic transducer.
Figure 15:
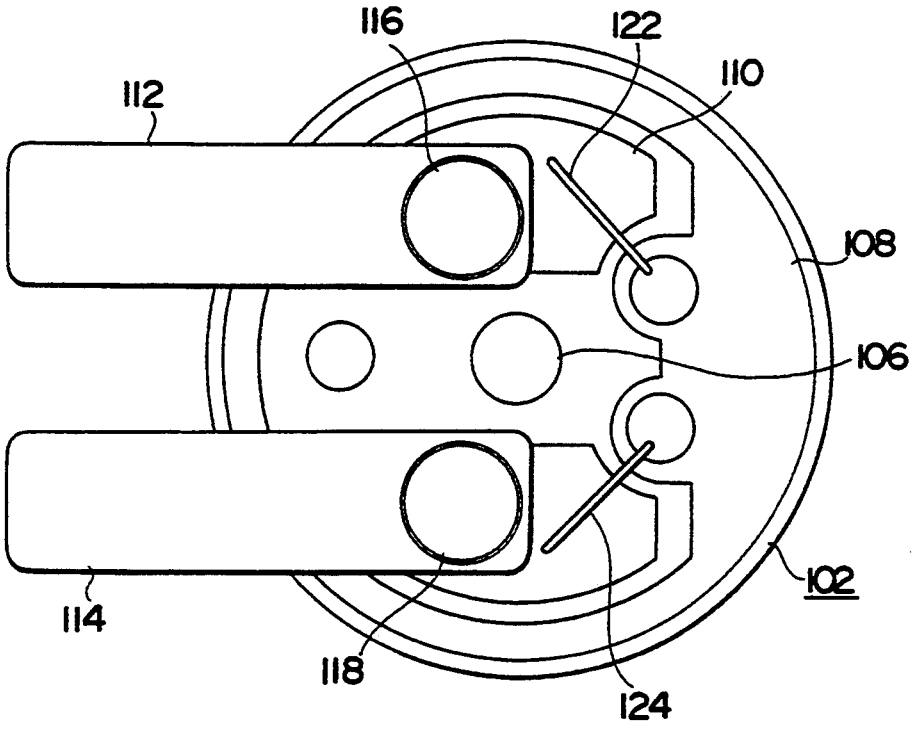
FIG. 15 PRIOR ART
FIG. 15 is a rear view of the electroacoustic transducer of FIG. 14.

The electroacoustic transducer includes a base portion 4 which is disposed at the rear side of a housing 2. A single metal base plate 40 is used for the base portion 4. The metal base plate 40 is formed of a single metallic plate made of a magnetic material to constitute a part of a magnetic circuit. The metal base plate 40 comprises a circular closing portion 42 for closing an opening of the housing 2 at the rear side thereof and a terminal portion 44 which is integrated with the closing portion 42. The terminal portion 44 extends from a part of the closing portion 42 in the diametrical direction thereof, replacing the prior art terminals 112 and 114 as illustrated in FIGS. 14 and. 15. The terminal portion 44 has an L-shaped bent portion 46 which extends in the front side of the metal base plate 40. The bent portion 46 is useful for external connections and provides mechanical strength.

The closing portion 42 and the terminal portion 44 have an insulating film 48 as an insulating means on the rear surface thereof by printing or coating an insulating paste, etc. thereon. A plurality of conductive patterns 50 and 52 are formed on the surface of the insulating film 48 so as to constitute terminal patterns as a means for electrical connections to an external device. The conductive patterns 50 and 52 correspond functionally to the prior art terminals 112 and 114. The conductive patterns 50 and 52 are formed by a conductor forming methods such as printing or plating conductive paste, and may be used for mounting circuits or elements of the electroacoustic transducer for miniaturization and simplification of electronic devices. The conductive patterns 50 and 52 are not always necessary to be mere lead means.

A plurality of through holes 54 and 56 are formed on the closing portion 42 slightly away from the center thereof. From the through holes 54 and 56, lead portions 22 and 24 of a coil 20 are drawn out. The coil 20 constitutes a part of the magnetic driving portion 5 in the housing 2 for producing magnetism in response to an applied electric signal. The through holes 54 and 56 are formed by punching a metallic plate which is the material of the metal base plate 40 before it is jointed to the housing 2. The through holes 54 and 56 can be replaced by a single or a plurality of notches from which the lead portions 22 and 24 are drawn out toward the rear side of the metal base plate 40.

The lead portions 22 and 24 which are drawn out from the through holes 54 and 56 are electrically connected to the conductive patterns 50 and 52. Solder or conductive bonding agent can be used as an electric connecting means. The through holes 54 and 56 are filled with an insulating material 53 for insulating the lead portions 22 and 24 from and fixing them firmly to the metal base plate 40. This prevents unnecessary stress on the lead portions 22 and 24. That is, the insulating material 53 protects the electroacoustic transducer from an accident such as a breakage of the lead portions, contributing to reliability of the electroacoustic transducer. The insulating material 53 serves as an insulating and fixing means and may be replaced by other means having the same function.

The housing 2 is a cylindrical body made of synthetic resins. The basic form of the housing 2 is the same as the prior art electroacoustic transducer. According to the first embodiment, since the single metal base plate 40 acts as the base portion 4, it occupies smaller space in the housing 2 so that the housing 2 can be lower in height.

An effective length of a core 6 attached to the base portion 4 is set to the length excluding both the portion penetrating the base plate 110 and the caulking portion of the prior art core as illustrated in FIG. 14, and hence shorter than the core 106 of the prior art electroacoustic transducer. Accordingly, the electroacoustic transducer is lower in height and thinner compared with the prior art electroacoustic transducer.

A through hole 58 is formed on the center of the metal base plate 40. A small diameter portion 60 of the core 6 is pressed into and fixed to the through hole 58 whereby the core 6 stands on the metal base plate 40. The core 6 functions as merely a magnetic core and need not serve as a connecting means for the base 108 and the base plate 110 as in the prior art core 106. That is, both the core 6 and the metal base plate 40 form a closed magnetic circuit to thereby constitute a part of a magnetic path of the magnetic driving portion 5. To fix the core 6 and the metal base plate 40, for example, the core 6 is screwed into the metal base plate 40 by threading both the small diameter portion 60 and the through hole 58. It is possible to employ various other methods such as welding, fixing by bonding agent, etc.

The magnetic driving force 5 comprises the coil 20 which is wound around the periphery of the core 6 and an annular magnet 26 which is disposed around the coil 20 while keeping a slight interval therebetween. The magnet 26 is firmly fixed to the upper surface of the metal base plate 40 by a bonding agent, etc.

The electroacoustic transducer has a diaphragm 30 which constitutes a closed magnetic circuit together with the magnet 26 and is driven by the vibrating magnetic field caused by the core 6 of the magnetic driving portion 5. The diaphragm 30 is supported by a cylindrical interval holding ring 28 surrounding the magnet 26. The interval holding ring 28 has a receiving surface provided at the inner peripheral portion thereof and the peripheral edge portion of the diaphragm 30 is fixed to the receiving surface. The housing 2 has a stepped portion 27 provided at the inner wall thereof which defines a small diameter portion at the front side thereof and a large diameter portion at the rear side thereof. The front side means the side for emitting sound and the rear side means the side opposite thereto. The interval holding ring 28 is engaged in and fixed to the large diameter portion of the housing 2, so it is positioned mechanically at a given location of the housing 2.

The diaphragm 30 has a magnetic piece 34 which is fixed at the center of the front surface thereof. The magnetic piece 34 is made of a magnetic material and serves as a means to add mass to the diaphragm 30 and to improve the magnetic efficiency. A resonant space 36 and a sound emitting hole 38 are respectively provided at the front side of the diaphragm 30 in the housing 2. The resonant space 36 is open to the atmosphere through the sound emitting hole 38. The sound emitting hole 38 is cylindrical and confronted with the magnetic piece 34. The resonant space 36 can occupy a sufficient space in the housing 2 by the employment of the metal base plate 40 even if the housing 2 is smaller compared with the prior art electroacoustic transducer, which realizes an excellent acoustic characteristics.

Figure 1:
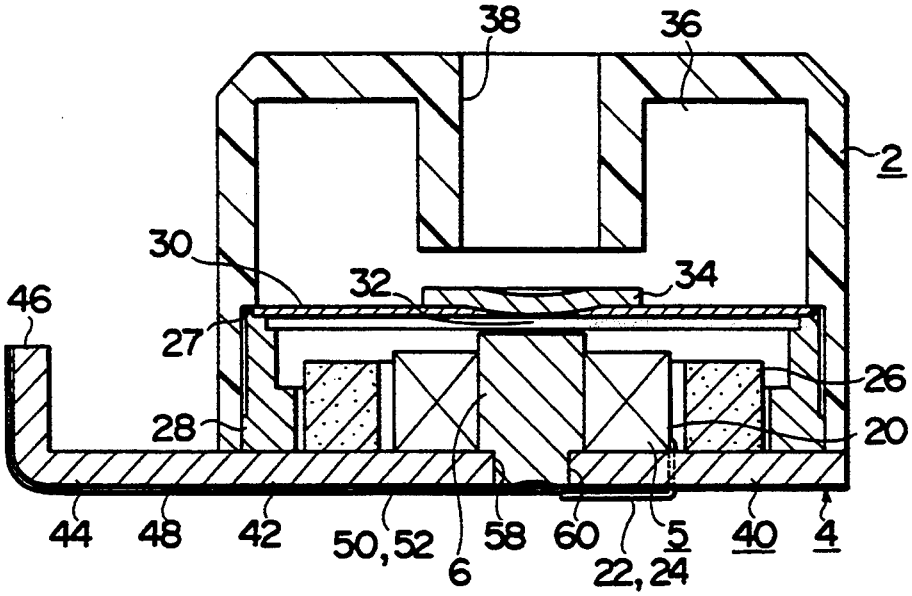
FIG. 1 is a longitudinal cross-sectional view of an electroacoustic transducer according to a first embodiment of the present invention.
Figure 2:
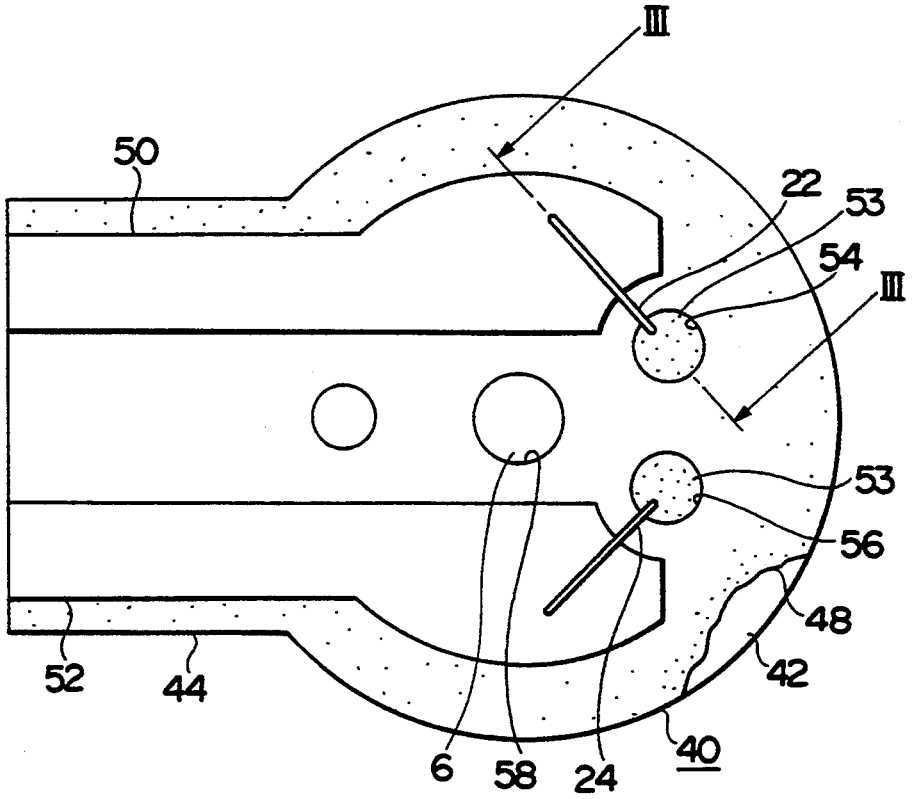
FIG. 2 is a partly cut-out rear view of the electroacoustic transducer of FIG. 1.
Figure 3:
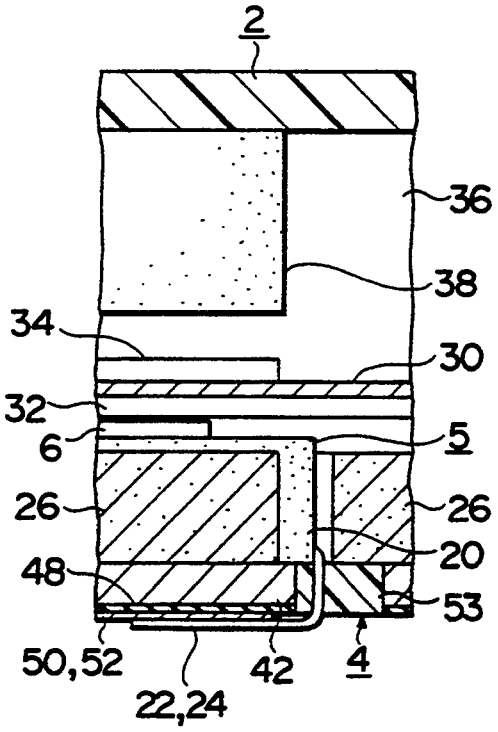
FIG. 3 is a partly cross-sectional view of the electroacoustic transducer taken along lines III—III of FIG. 2.
Figure 4:
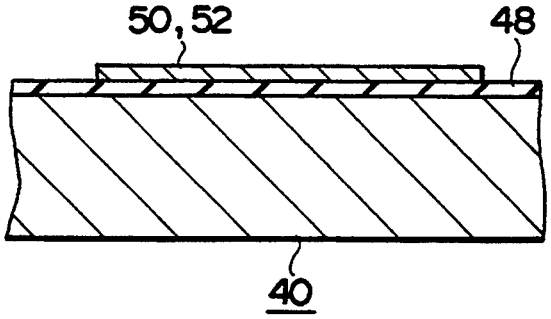
FIG. 4 is a cross-sectional view showing the structure of a metal base plate of the electroacoustic transducer of FIG. 1.

FIG. 4 shows a concrete embodiment of the metal base plate 40 which serves as a closing means for the opening of the housing 2 and also constitutes a part of the closed magnetic circuit. Accordingly, the metal base plate 40 is made of a metallic plate so as to give a suitable rigidity thereto. The metal base plate 40 has two conductive patterns 50 and 52 which constitute the terminals where the leads 22 and 24 of the coil 20 are connected. The insulating film 48 is formed on the surface of the metal base plate 40 using an insulating paste, etc. The conductive patterns 50 and 52 are formed on the insulating film 48 by printing the conductive paste, etc. The insulating film 48 may be a resist or an oxide film or the like while the conductive patterns 50 and 52 may be a copper foil, etc. Since the conductive patterns 50 and 52 constitute the terminals, the terminal structure and manufacturing process are simplified compared with the prior art terminals 112 and 114 which are caulked by the caulking pins 116 and 118.

Figure 5:
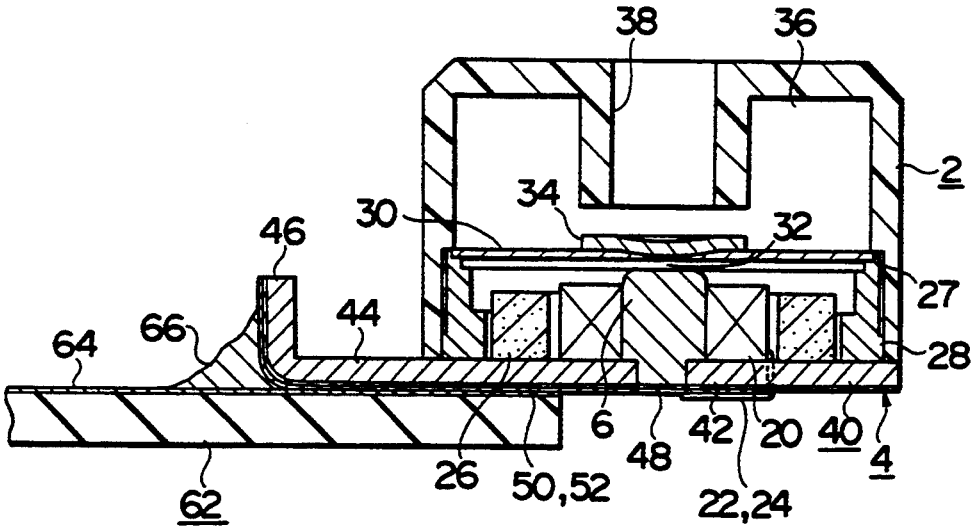
FIG. 5 is a longitudinal cross-sectional view showing the state of attachment of the electroacoustic transducer of FIG. 1.

The closing portion 42 and the terminal portion 44 may be electrically connected and mechanically fixed by solder 66 to a conductive pattern 64 of a printed board 62, as illustrated in FIG. 5. It is not necessary to provide an additional member for mounting the electroacoustic transducer. Furthermore, it is possible to simplify mechanical and electrical arrangement around the electroacoustic transducer.

The employment of the metal base plate 40 simplifies and thins the base portion 4. It requires no change to the effective length of the core 6 and the form of the magnetic driving portion 5 including the magnet 26, etc. Furthermore, the core 6 merely functions as a magnetic means and need not serve as a connecting member for other members and need not be long enough for caulking as in the prior art core 106. Accordingly, the structure and working or assembling process can be simplified by the reduction of the number of parts. The simplified base portion 4 avoids the double structure of the base 108 and the base plate 110 in the prior art electroacoustic transducer. As a result, a vibrating structure is simplified to thereby restrain unnecessary vibration, which leads to the improvement of the acoustic characteristics.

According to the first embodiment, the employment of the metal base plate 40 as the base member can thin and miniaturize the electroacoustic transducer and also simplify the terminal structure. However, the base member according to the present invention does not influence the internal structure of the electroacoustic transducer. Accordingly, it is possible to simplify the terminal structure in the prior art electroacoustic transducer only by employing the base member of the present invention. Accordingly, an electroacoustic transducer according to the present invention is not limited to the structure of the magnetic driving portion as explained hereinabove.

According to the first embodiment, the through holes 54 and 56 are formed on the metal base plate 40 from which the leads portions 22 and 24 of the coil 20 are drawn out. A modified embodiment is being described. Conductive patterns are formed on both front and rear surfaces of the metal base plate 40 with insulating films between them. Through holes are formed on the metal base plate 40 and conductive patterns are formed on the inner surfaces of the holes. The conductive patterns on the front and rear surfaces are connected by the conductive pattern of the through hole. Then the lead portions 22 and 24 may be connected to the conductive pattern on the front side of the metal base plate 40.

Figure 6:
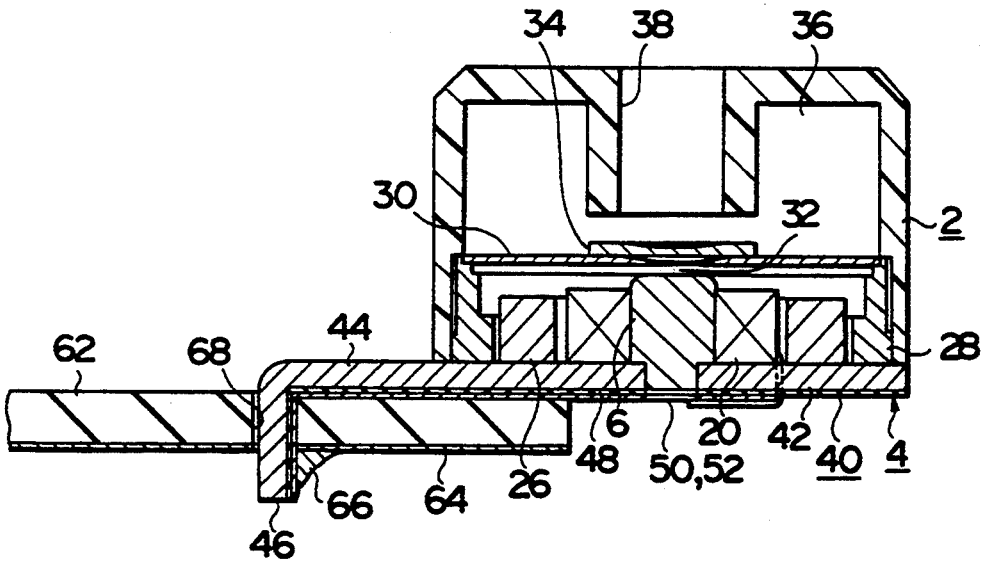
FIG. 6 is a longitudinal cross-sectional view of an electroacoustic transducer according to a second embodiment of the present invention showing the state of attachment of the same electroacoustic transducer.

Second Embodiment (FIG. 6)

FIG. 6 shows a second embodiment of an electroacoustic transducer according to the present invention.

Elements of electroacoustic transducer which are the same as those in the first embodiment are denoted at the same numerals and the explanation thereof is omitted throughout the second to fifth embodiments.

The bent portion 46 provided on the terminal portion 44 of the metal base plate 40 may be extended in the rear side of the metal base plate 40 as illustrated in FIG. 6, which does not impede a simplification of the base portion. Particularly, the employment of the metal base plate 40 not only miniaturizes the electroacoustic transducer but also changes the terminal structure. That is, the metal base plate 40 has extensive functions beyond the function as a lead, namely, it constitutes a part of a circuit and simplifies fixing means to the printed board 62. A through hole 68 is formed on the printed board 62, having the shape and size through which the bent portion 46 can be inserted. The bent portion 46 is inserted through the through hole 68 and fixed temporarily to the printed board 62. The metal base plate 40 can be electrically connected and mechanically fixed to the printed board 62 by solder 66 or conductive bonding agent which is placed between the conductive pattern 64 provided at the rear surface of the printed board 62 and the bent portion 46. Compared with the embodiment as illustrated in FIG. 5, fixing strength between the metal base plate 40 and the printed board 62 is increased, thereby enhancing the reliability thereof.

Although the terminal portion 44 and the printed board 62 are connected or fixed using solder or conductive bonding agent according to the second embodiment, they may fixed using a mechanical fixing means such as a screw, nut, etc. If the terminal portion 44 is mounted on a metal chassis, a part of the chassis may be cut and raised for fixation.

Figure 7:
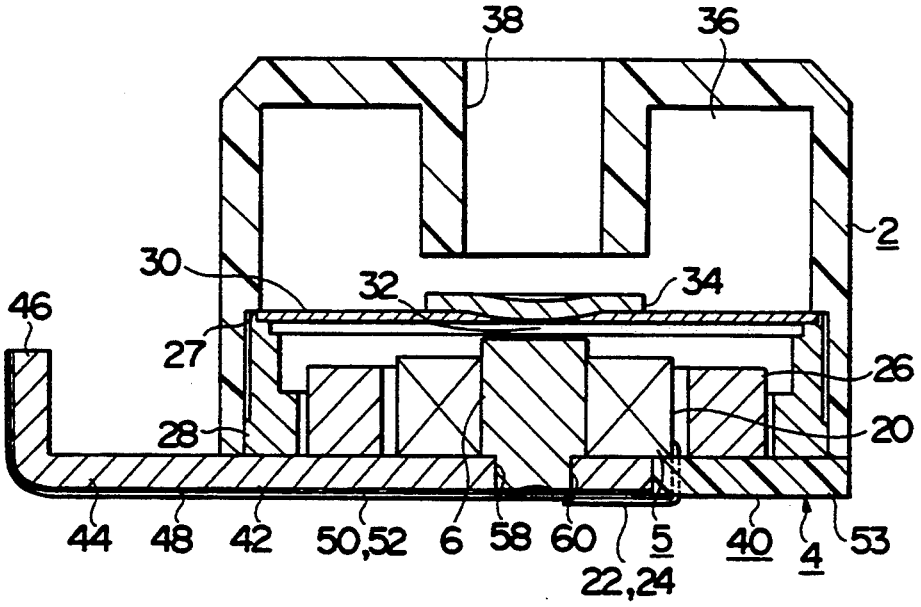
FIG. 7 is a longitudinal cross-sectional view of an elecroacoustic transducer according to a third embodiment of the present invention.
Figure 8:
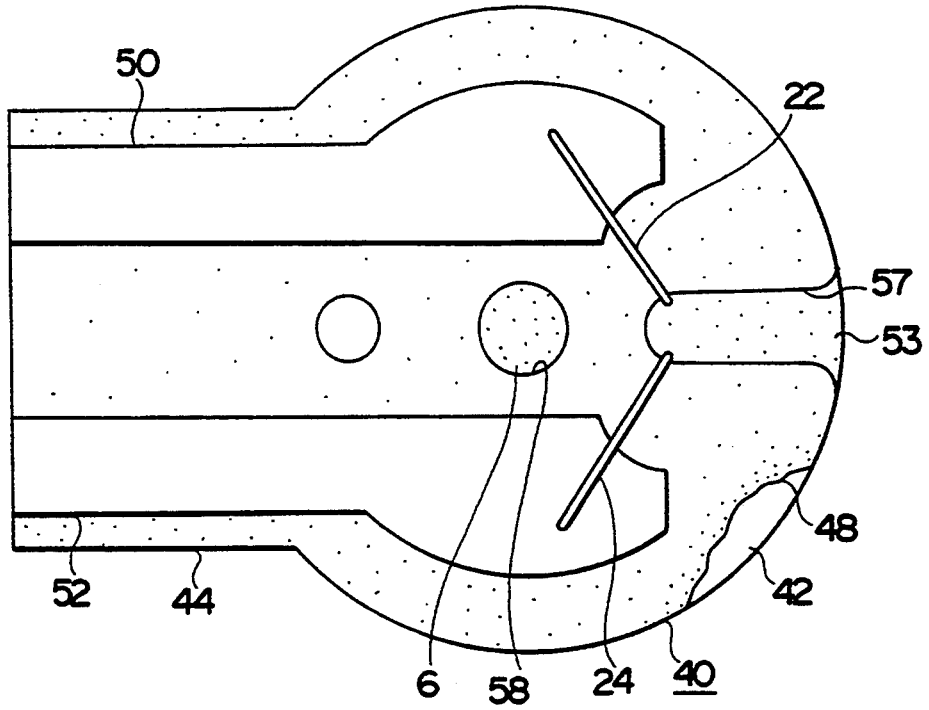
FIG. 8 is a partly cut-out rear view of the electroacoustic transducer of FIG. 7.

Third Embodiment (FIGS. 7 and 8)

An electroacoustic transducer according to a third embodiment of the present invention will be described with reference to FIGS. 7 and 8.

A single U-shaped notch 57 is formed on the metal base plate 40 according to the third embodiment instead of the through holes 54 and 56 of the first and second embodiments. The notch 57 is open to the peripheral direction of the metal base plate 40. The lead portions 22 and 24 of the coil 20 are drawn out to the rear side of the metal base plate 40 by way of the notch 57 and connected individually to the conductive patterns 50 and 52.

The metal base plate 40 is easily worked to form the single notch compared with the through holes 54 and 56. The lead portions 22 and 24 are easily drawn out to the rear side of the metal base plate 40 compared with the first and second embodiments since the notch 57 is open to the peripheral direction of the metal base plate 40 and the fine lead portions 22 and 24 need not be passed through the through holes 54 and 56. This leads to the reduction of the manufacturing cost of the electroacoustic transducer. The notch 57 is filled with the insulating material 53 such as synthetic resins to seal the rear surface of the housing 2 in the same way as the first embodiment. The insulating material 53 which is filled in the notch 57 serves as a fixing and protecting means for the lead portions 22 and 24 from accidents such as a breakage of the lead portions 22 and 24, which contributes to the reliability of the electroacoustic transducer.

Figure 9:
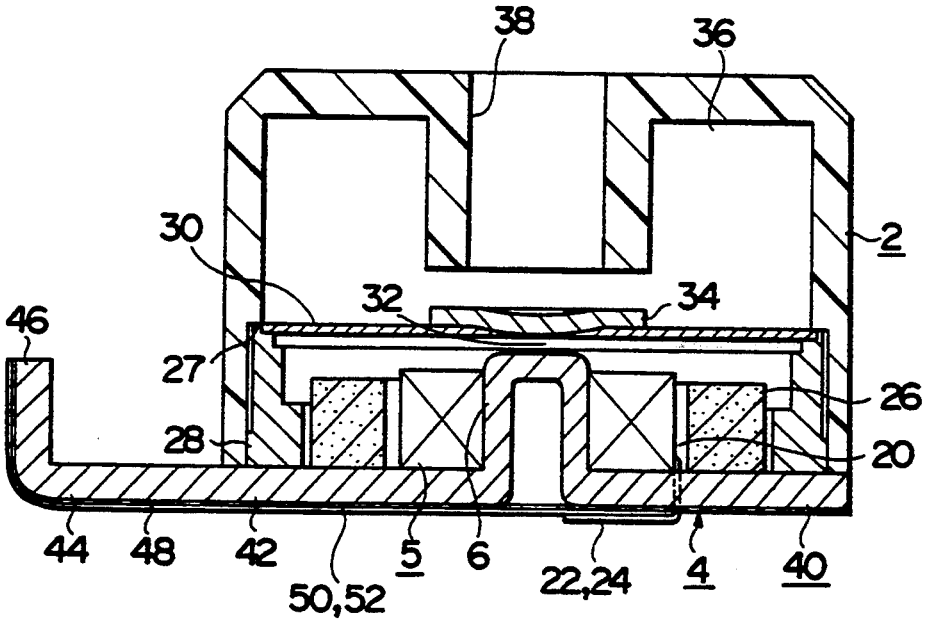
FIG. 9 is a longitudinal cross-sectional view of an electroacoustic transducer according to a fourth embodiment of the present invention.
Figure 10:
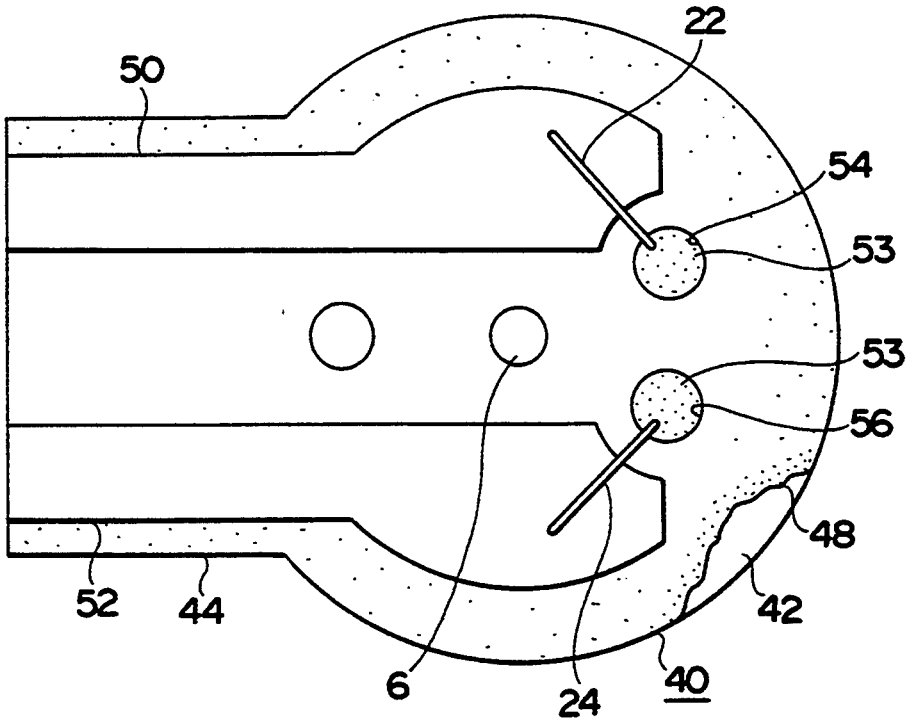
FIG. 10 is a partly cut-out rear view of the electroacoustic transducer of FIG. 9.

Fourth Embodiment (FIGS. 9 and 10)

An electroacoustic transducer according to a fourth embodiment of the present invention will be described with reference to FIGS. 9 and 10.

The metal base plate 40 and the core 6 are integrated to form a single member according to the fourth embodiment although they are separate members according to the first to third embodiments. Metal base plate 40 is made of a magnetic material, the core 6 is formed as a part of the metal base plate 40 at the center of one side of the closing portion 42. The closing portion 42 are drawn out at the center so as to form a rod-shape core like the prior art core 106.

Since the core 6 is formed by the metal base plate 40, it functions merely as a magnetic core without a need for conventional fixing means. The core 6 is not mechanically connected to the base portion but integrated with the metal base plate 40 to form a closed magnetic circuit so as to constitute a part of the magnetic path of the magnetic driving portion 5. Accordingly, the magnetic characteristics is excellent, which favorably influences the acoustic characteristics.

This structure simplifies the base member and dispenses with a core as a separate member. As a result, the number of parts can be reduced and the electroacoustic transducer can be simplified in structure and lowered in height. Furthermore, the integration of the base member with the core can improve both the magnetic and acoustic characteristics. Still furthermore, the simplification of the base member controls unnecessary vibration to improve the acoustic characteristics.

Figure 11:
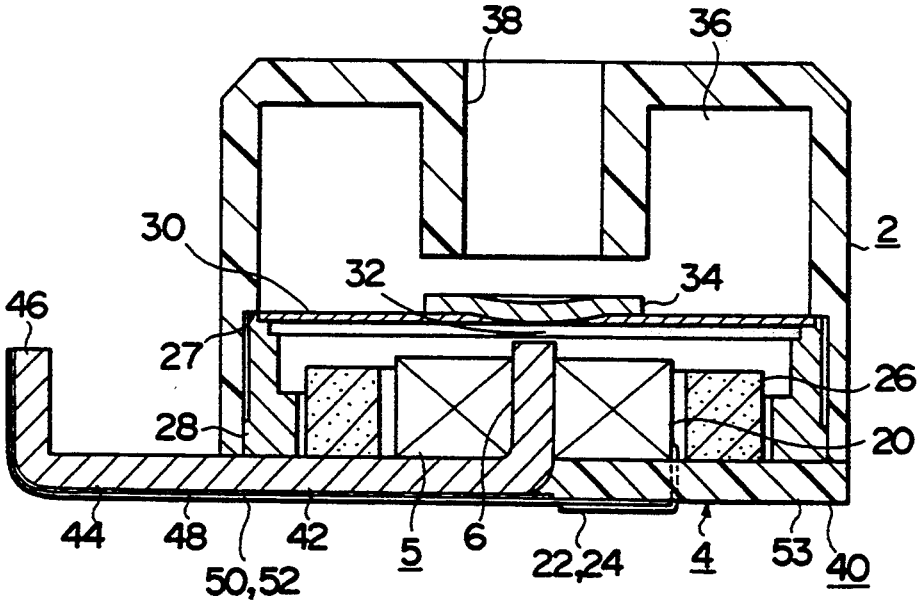
FIG. 11 is a longitudinal cross-sectional view of an electroacoustic transducer according to a fifth embodiment of the present invention.
Figure 12:
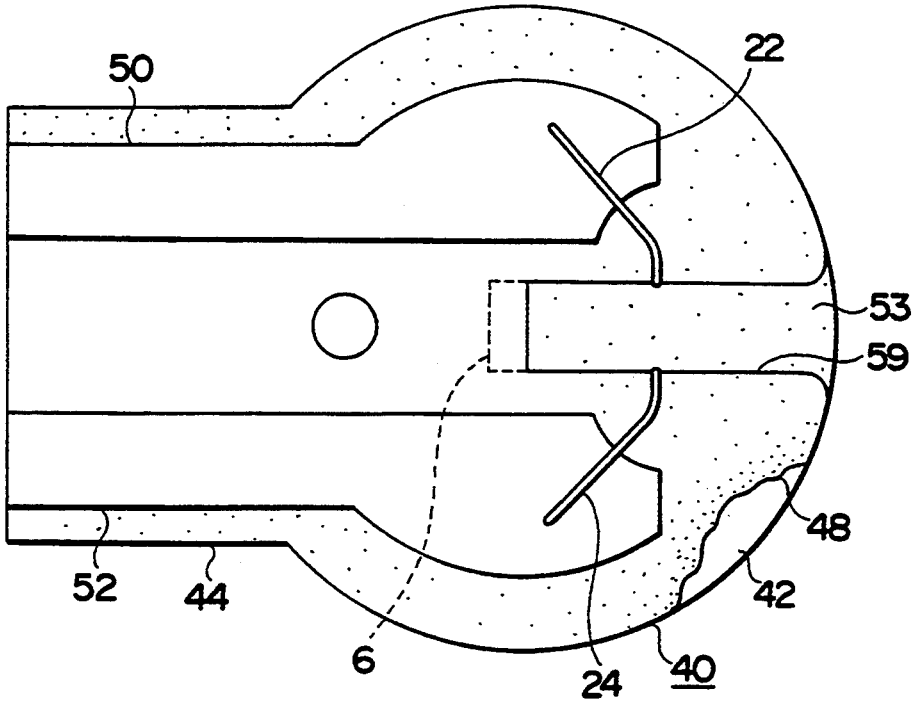
FIG. 12 is a partly cut-out rear view of the electroacoustic transducer of FIG. 11.
Figure 13:
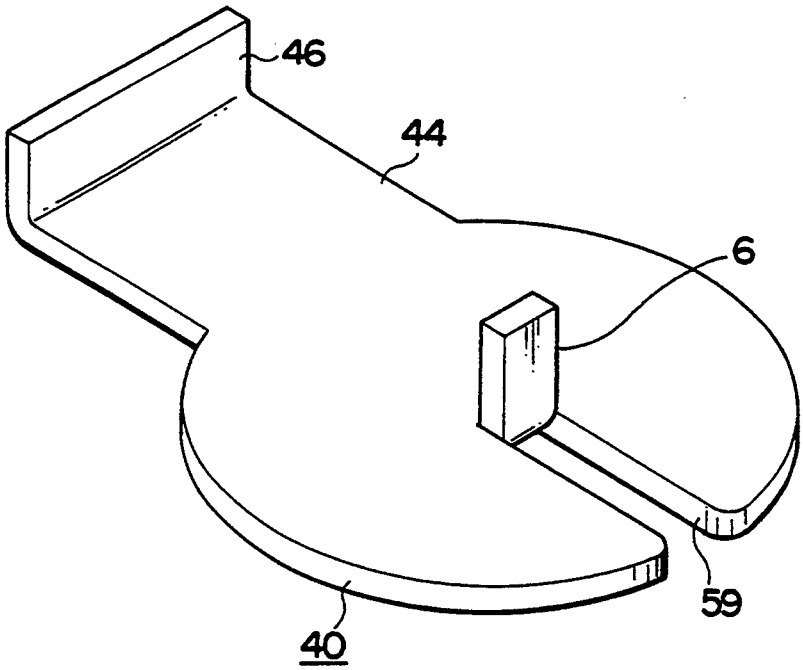
FIG. 13 is a perspective view showing a metal base plate employed in the electroacoustic transducer of FIG. 12.

Fifth Embodiment (FIGS. 11 to 13)

An electroacoustic transducer according to a fifth embodiment of the present invention will be described with reference to FIGS. 11 to 13.

A part of the metal base plate 40 is cut and raised to form the core 6 according to the fifth embodiment as illustrated in FIGS. 11 and 12 although the core 6 is formed by drawing the metal base plate 40 according to the fourth embodiment. A notch 59 is formed on the metal base plate 40 by cutting and raising a part thereof. FIG. 13 shows the metal base plate 40 having the core 6 formed thereon.

The metal base plate 40 is simply worked to provide the core 6 by cutting and raising a part thereof so that the metal base plate 40 and the core 6 is integrated like the fourth embodiment. Such a structure can obtain the same effect as the third embodiment and furthermore the structure of the metal base plate 40 and the core 6 is more simplified than the first to fourth embodiments. Still furthermore, the core 6 can be made more easily than the fourth embodiment so that the manufacturing cost of the electroacoustic transducer can be reduced.

It may be possible to form conductive patterns 50 and 52 on the front surface of the metal base plate 40 where the housing 2 is attached with the insulating film 48 between them connect the lead portions 22 and 24 although they are formed on the rear surface of the metal base plate 40 according to the first to fifth embodiments.

As mentioned hereinabove, according to the present invention, since the terminal patterns are formed on the metal base member with the insulating film between them and the lead portions of the coil of the magnetic driving portion are connected to these terminal patterns, it is possible to reduce the number of parts and the number of steps of assembly, to simplify the structure of the electroacoustic transducer so that the electroacoustic transducer can be miniaturized and thinned and furthermore, to improve the acoustic characteristics.

Although the invention has been described in its preferred form, it is to be understood that many variations and changes are possible without departing from the scope thereof.

What is claimed is:

1. An electroacoustic transducer having a magnetic driving portion and a diaphragm accommodated in a housing for generating sound by way of said diaphragm which is vibrated by an oscillating magnetic field generated in said magnetic driving portion in response to an electric signal, wherein said magnetic driving portion comprises:

an interval holding ring provided inside an inner periphery of said housing;

an annular magnet provided inside said interval holding ring;

a core provided inside said annular magnet; and a coil wound around said core;

said magnetic driving portion generating said oscillating magnetic field in response to said electric signal applied to said coil for vibrating said diaphragm;

said housing further comprising a resonance space formed at a front side of said diaphragm;

a sound emitting hole for allowing said resonance space to be open to the atmosphere to emit sound thereto; and said housing accommodating therein said magnetic driving portion at a rear side of said diaphragm and having an opening at a rear side of said magnetic driving portion; and a base member closing said opening of said housing;

said base member being formed of a metallic plate, an external surface of which is coated with an insulating film having terminal patterns externally formed thereon, and the terminal patterns being connected to leads of said coil of said magnetic driving portion.

2. An electroacoustic transducer according to claim 1, wherein said base member having said terminal patterns on a rear side thereof comprises through holes for passing said leads therethrough to electrically connect the same to said terminal patterns.

3. An electroacoustic transducer according to claim 1, wherein said base member having said terminal patterns on a rear side thereof includes a notch therein through which said leads of said coil are passed to be electrically connected to said terminal patterns.

4. An electroacoustic transducer according to claim 1, wherein said core is press fitted into a through hole formed in said base member.

5. An electroacoustic transducer according to claim 1, wherein said base member is made of magnetic material and said core is formed by deforming a section of said base member upright.

6. An electroacoustic transducer according to claim 1, wherein said terminal patterns are electrically connected to an external printed circuit board.

7. An electroacoustic transducer according to claim 1, wherein said base member comprises a bent edge portion of said base member, said bent portion being inserted into a through hole formed in a printed circuit board for securing said electroacoustic transducer thereon.

* * * * *